United States Patent [19]

Park et al.

[11] Patent Number: 4,479,557

[45] Date of Patent: Oct. 30, 1984

[54] METHOD AND APPARATUS FOR REDUCING FIELD FILTER CAKE ON SPONGE CORES

[75] Inventors: Arthur Park, Odessa; Bob T. Wilson, Midland, both of Tex.

[73] Assignee: Diamond Oil Well Drilling Co., Midland, Tex.

[21] Appl. No.: 513,267

[22] Filed: Jul. 13, 1983

[51] Int. Cl.[3] ..... E21B 25/06; E21B 25/10

[52] U.S. Cl. ..... 175/59; 175/249

[58] Field of Search ..... 175/20, 58, 59, 226, 175/244, 249–253, 308, 403

[56] References Cited

U.S. PATENT DOCUMENTS

| | | | |
|---|---|---|---|
| 1,815,391 | 7/1931 | Zublin et al. | 175/249 |
| 1,853,581 | 4/1932 | Schmissrauter . | |
| 1,857,693 | 5/1932 | Quintrell | 175/249 |
| 1,859,950 | 5/1932 | Zublin | 175/249 |
| 1,895,001 | 1/1933 | Macready | 175/253 |
| 2,264,449 | 12/1941 | Mounce . | |
| 2,703,697 | 3/1955 | Walker . | |
| 2,779,195 | 1/1957 | Simon | 175/59 |
| 2,789,790 | 4/1957 | Kirby . | |
| 3,064,742 | 11/1962 | Bridwell . | |
| 3,207,240 | 9/1965 | Hugel . | |
| 3,454,117 | 7/1969 | Eckell et al. . | |
| 4,312,414 | 1/1982 | Park | 175/59 |

*Primary Examiner*—Stephen J. Novosad
*Assistant Examiner*—William P. Neuder
*Attorney, Agent, or Firm*—Jerry W. Mills; Gregory M. Howison; Nina Medlock

[57] ABSTRACT

A well coring apparatus (10) includes an outer barrel (12) and an inner barrel (18). The inner barrel (18) is sealed with a rupturable diaphragm (24) and a check valve (49). A sponge (50) is disposed around the inner walls of the inner barrel (18) for contacting the core (58). A fluid (54) is disposed in the sealed inner barrel (18) to prewet the sponge (50). A piercer (32) is reciprocally disposed within the outer barrel (12) and has a conical shaped surface (38), the apex of which is operable to pierce the diaphragm (24). In response to forming of the core (58), the fluid (54) displaced by the core (58) prevents drilling mud from being disposed between the core (58) and the sponge (50).

34 Claims, 3 Drawing Figures

METHOD AND APPARATUS FOR REDUCING FIELD FILTER CAKE ON SPONGE CORES

TECHNICAL FIELD

This invention pertains in general to apparatus for well coring and, more particularly, to well coring apparatus utilizing an absorbant sponge for containing the subterranean fluid in the core.

BACKGROUND OF THE INVENTION

To analyze the amount of oil that is contained in a particular soil at a particular depth in the proximity of a subterranean well requires extraction of a sample of the well material. Analysis of this material yields the percent of fluid and/or gas contained therein which is utilized to determine the type of fluid, such as oil, contained therein and the pressure thereof. However, it is important in order to obtain an accurate analysis to extract the core in as intact a condition as possible. Since the fluid and gas are contained in the core material at a pressure dependent upon the depth of the well, extraction of this core to an environment with a lower pressure results in the fluid expanding somewhat and the gas coming out of solution. In addition, the "mobile oil" contained in the core may also drain or "bleed" out of the core and be lost. Mobile oil is oil that passes through the core material and is a function of the permeability and porosity of the core itself and the volume of fluid contained therein.

One method for retaining mobile oil is sponge coring which is disclosed in U.S. Pat. No. 4,312,414, issued to the present Applicant. Sponge coring comprises disposing a high porosity sponge on the interior surface of the inner barrel of the well coring apparatus. The core is then forced into the inner barrel with the sponge disposed about the sides thereof. The oil and/or gas contained in the core then "bleeds" into the sponge thereby retaining an accurate profile of the oil along the longitudinal axis of the core.

There are a number of problems incurred during sponge coring to achieve accurate data. One of these problems is in having the surface of the sponge contacting the actual surface of the core with no contaminants disposed therein. During normal drilling operations, drilling mud, or a similar lubricant, is circulated around the coring bit. This drilling mud has a tendency to "cake" on the core which, when it is pushed up into the sponge in the inner barrel, can impede bleeding of the oil and/or gas to the sponge for retention therein. This results in a certain degree of inaccuracy. This problem is exacerbated by the high differential pressures that can result within a bore hole due to the formation pressure and the pressure of the drilling mud within the bore hole. Therefore it is necessary to minimize the build-up of this filter cake.

In view of the above described disadvantages with sponge coring, there exists a need for a sponge coring apparatus with reduced field filter cake build-up on the core to increase the accuracy of sponge analysis.

SUMMARY OF THE INVENTION

The present invention disclosed and claimed herein comprises a method and apparatus for recovery of subterranean fluid. The apparatus includes a well coring apparatus for boring a well containing the subterranean fluid. A container is associated with the coring apparatus for receiving and containing the well core for later retrieval. An absorbant member is disposed on the inner walls of the container and positioned adjacent the well core for absorbing the subterranean fluid that bleeds from the well core. The container is sealed from the external environment of the bore hole with a rupturable seal on the receiving end thereof. A reciprocating member is disposed within the well coring apparatus for breaking this rupturable seal in response to the forming of the core such that a core enters the container relatively unobstructed.

In another embodiment of the present invention, the sealed container has two open ends with the rupturable seal formed at the receiving end thereof and a check valve disposed on the other end thereof for allowing efferent flow only. The reciprocating member is a piston having a planar surface for contacting the well core and a conical shaped surface on the opposite side thereof with an apex for rupturing the rupturable seal.

In yet another embodiment of the present invention, the sealed container is filled with a fluid for reducing the field filter cake that surrounds the core as it is being formed. This fluid is displaced from the absorbant member as fluid from the core bleeds therebetween.

In a further embodiment of the present invention, a method for recovering the subterranean fluid comprises disposing an absorbant material in the inner barrel of the well coring apparatus on the walls thereof and then sealing the inner barrel from the external environment of the well core. The fluid is disposed within the container containing the absorbant material and then the inner barrel is disposed into the well with the well coring apparatus. The seal to the inner barrel is broken in response to the forming of the well core such that the well core enters the inner barrel and the absorbant material in the inner barrel is relatively uncontaminated, the fluid contained therein preventing field filter cake that is disposed around the formed well core from impeding fluid exchange from the well core to the absorbant material.

In a yet further embodiment of the present invention, a method for forming the well core and retrieving the subterranean fluid contained therein includes impregnating the absorbant member with a fluid at a high pressure prior to placing the inner barrel into the well coring apparatus. A vacuum is first drawn on the inner barrel containing the absorbant member and then the fluid is disposed in the inner barrel at a high pressure, thereby impregnating the material of the absorbant member with the fluid. Impregnation of the absorbant member with the fluid reduces field filter cake problems.

BRIEF DESCRIPTION OF THE DRAWINGS

For a more complete understanding of the present invention and the advantages thereof, reference is now made to the following description taken in conjunction with the accompanying Drawings in which.

DETAILED DESCRIPTION OF THE INVENTION

Figure 1:
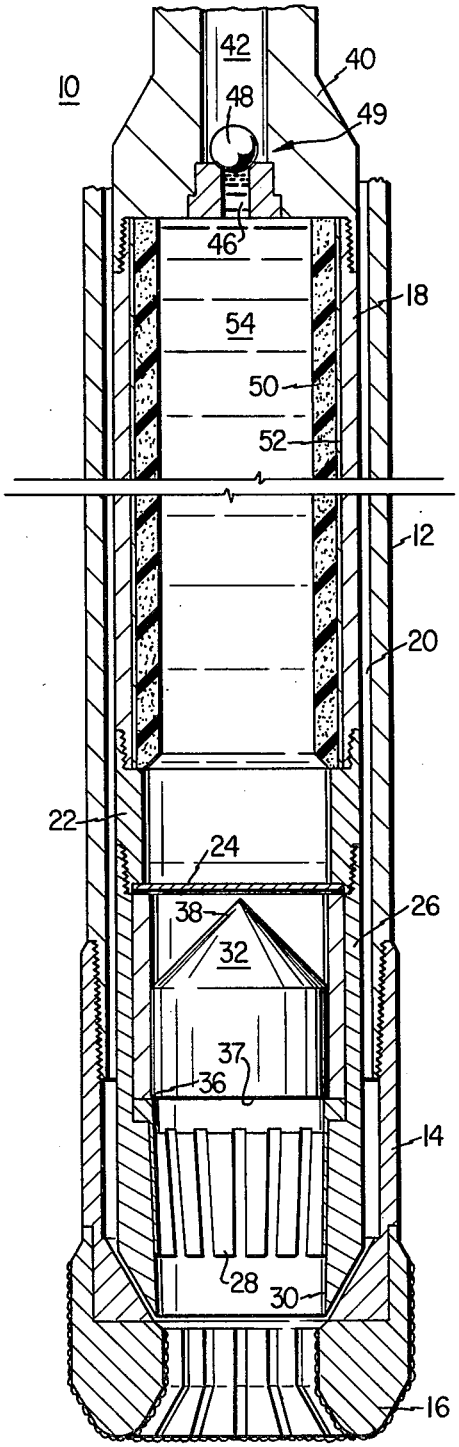
FIG. 1 illustrates a cross-sectional view of the sponge coring apparatus of the present invention.

Referring now to FIG. 1, there is illustrated a cross-sectional view of a well coring apparatus 10. The well coring apparatus 10 includes an outer barrel 12 that has a bit sub 14 disposed on the end thereof. The bit sub 14 is utilized to couple a coring bit 16 to the outer barrel 12. The coring bit 16, the bit sub 14 and the outer barrel 12 are co-rotatable by an external drilling apparatus (not shown) for drilling a core. The description of the coring procedure is described in U.S. Pat. No. 4,312,414, issued to the present Applicant, the body of which is incorporated herein by reference.

An inner barrel 18 is disposed within the outer barrel 12 such that an annular channel 20 is formed therebetween. This annular channel 20 allows drilling fluids to pass therethrough to the coring bit 16. The inner barrel 18 is stationary with respect to rotation of the outer barrel 12 and is designed for receiving the core that is formed during the coring process. This inner barrel 18 has a receiving end for receiving the well core and an exhaust end for exhausting material contained within the inner barrel 18 as the core progresses upward therethrough. A seal housing 22 is threadedly disposed on the receiving end of the inner barrel 18 through which the core must pass before it enters the inner barrel 18. The seal housing 22 has a rupturable diaphragm 24 disposed over the open end thereof. In order for the core to enter the seal housing 22 and the inner barrel 18, this diaphragm 24 must be ruptured.

A core catcher bowl 26 is threadedly engaged with the seal housing 22. A core catcher 28 is disposed in the core catcher bowl 26 adjacent the opening thereof. The core catcher bowl 26 has a receiving end 30 for receiving the core to be formed. The annular channel 20 is disposed between the wall formed by the outer barrel 12, the core bit sub 14 and the coring bit 16 and the wall formed by the inner barrel 18, the seal housing 22 and the core catcher bowl 26.

A piercer 32 is disposed in the core catcher bowl 26 and spaced from the sides thereof by a cylindrical insert 34. The piercer 32 is essentially a piston having a planar surface 36 for contacting the core being formed and a conical surface 38 disposed diametrically opposite the planar surface 36. The planar surface 36 is essentially perpendicular to the longitudinal axis of the overall apparatus 10. The conical surface 38 has the apex thereon oriented proximate to the longitudinal axis of the inner barrel 18 for traversal therealong. The piercer 32 is operable to pierce the rupturable diaphragm 24 in response to pressure applied to the planar surface 36 by the core being formed. The diameter of the piercer 32 is slightly larger than the upper portion of the core catcher 28 such that reciprocation downward through the coring bit 16 is prevented. Therefore, the core that is formed with the apparatus 10 is also slightly smaller in diameter than the piercer 32.

The end of the inner barrel 18 opposite that attached to the seal housing 22 has a flow tube 40 threadedly attached thereto. The flow tube 40 has an orifice 42 disposed axially therethrough. Although not shown, fluid also flows around the flow tube 40 into the annular channel 20 for passage to the surface of the coring bit 16. A check valve seat 44 is disposed in the orifice 42 of the flow tube 40. The seat 44 has an orifice 46 axially disposed therethrough to allow communication between the orifice 42 and the interior of the inner barrel 18. A check valve ball 48 is disposed in the seat 44 for impeding afferent flow to the inner barrel 18. However, the ball 48 is operable to allow afferent flow from the interior of the inner barrel 18 when the pressure interior thereto exceeds the pressure in the orifice 42 of the flow tube 40. The check valve ball 48 and the seat 44 form an overall check valve 49.

A cylindrical sponge 50 is disposed on the interior walls of a cylindrical support member or liner 52. The liner 52 is dimensioned to slideably fit within the inner barrel 18 adjacent the walls thereof. In the preferred embodiment, the liner 52 is fabricated from aluminum and the sponge 50 is fabricated from polyurethane foam. The use and construction of this foam is disclosed in U.S. Pat. No. 4,312,414, issued to the present Applicant.

The sponge 50 is dimensioned to define a bore through the middle thereof for receiving the core. Pressure of the drilling fluid in the orifice 42 of the check valve 49 seals the ball 48 and prevents drilling mud from entering the interior of the inner barrel 18. The rupturable diaphragm 24 prevents entrance of drilling mud from the opposite end thereof thereby resulting in a sealed chamber. As will be described hereinbelow, this chamber is filled with a fluid 54.

Figure 2:
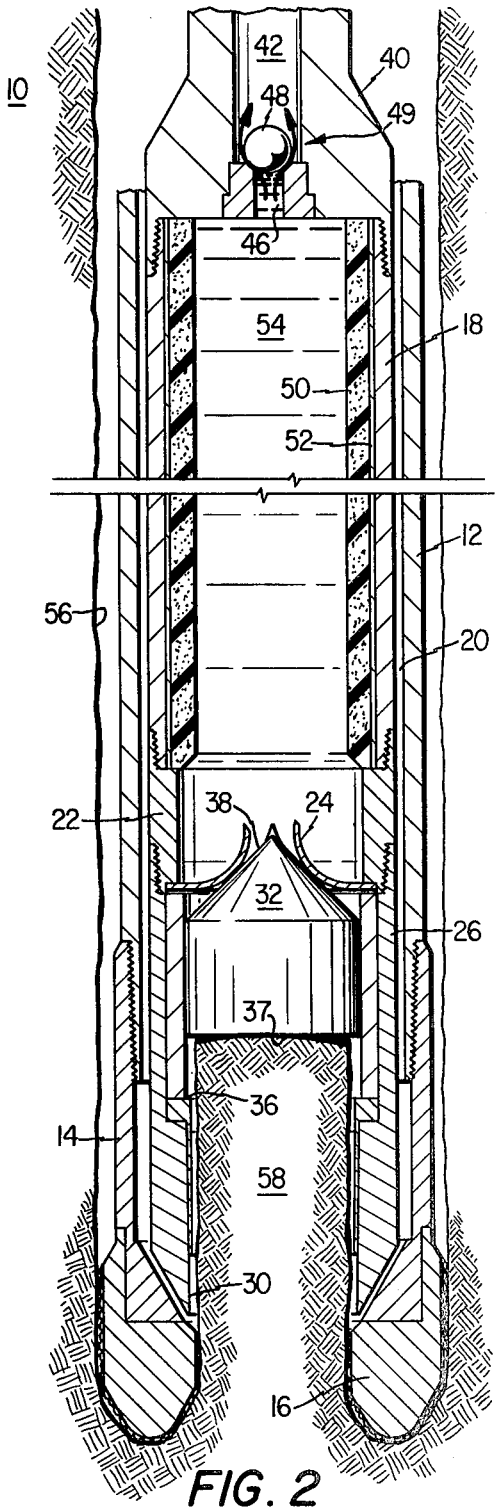
FIG. 2 illustrates a cross-sectional view of the sponge coring apparatus of the present invention disposed in a subterranean well with the piercer penetrating the rupturable seal.
Figure 3:
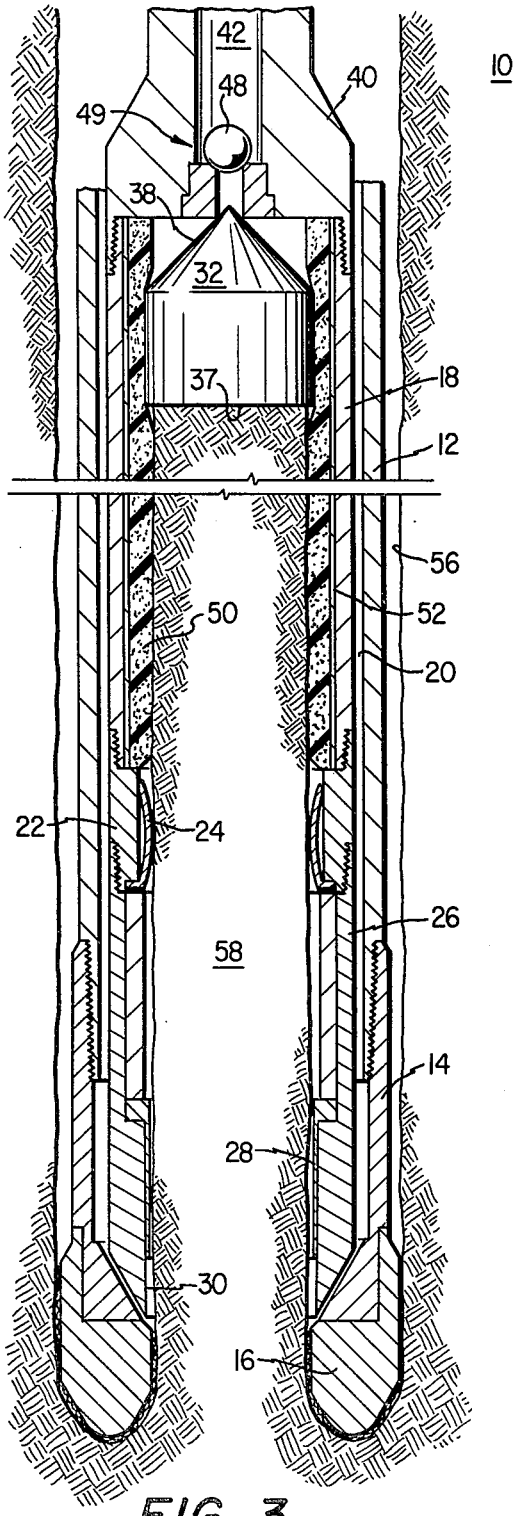
FIG. 3 illustrates a cross-sectional view of the sponge coring apparatus of the present invention with the formed core fully disposed within the inner barrel.

Referring now to FIG. 2, there is illustrated a cross-sectional diagram of the apparatus 10 disposed in a subterranean well 56 and partially forming a core 58. The piercer 32 is illustrated at a position wherein the rupturable diaphragm 24 has just been ruptured. FIG. 3 illustrates the position wherein the core has passed through the rupturable diaphragm and into the interior of the inner barrel 18 for contact with the sponge 50. As illustrated, the piercer 32 advances upward into the inner barrel 18 until it contacts the upper end of the inner barrel 18. During this reciprocation, the fluid 54 contained in the interior of the inner barrel 18 passes upward through the orifice 46 with a small portion passing downward around the core 58 and out past the coring bit 16. The piercer 32, as described above, has a diameter that is slightly larger than the diameter of the core 58. In this manner, the piercer 32 forms a hole through the diaphragm 24 that is larger than the core 58 itself, thereby preventing disruption of the outer surface of the core 58. This is important in that it is the surface of the core 58 through which the oil and subterranean fluid contained therein must pass to the sponge 50.

Since the diaphragm 24 must "curl back" from the core passageway, the inner diameter of the seal housing 22 is dimensioned to be larger than that of the core 58, thereby allowing adequate room for the edges of the ruptured diaphragm 24 to be removed from the path of the core 58. When the core 58 passes into the portion of the inner barrel 18 that houses the sponge 50, the interior diameter thereof is dimensioned less than the diameter of the core 58 to form a tight fit therewith. The sponge 50 is relatively compressible in that it has a high porosity, thereby allowing a certain degree of compression.

The sealed inner barrel 18 allows location of the apparatus 10 within the bore hole without allowing drilling mud to penetrate the interior of the inner barrel 18. If the drilling mud were allowed to contact the surfaces of the absorbant member 50, there is a high probability that some of the drilling mud would "cake" on the surfaces thereof. This caking would substantially impair "bleeding" of oil or subterranean fluid from the core 58 to the absorbed member 50 for retention therein. Therefore, the use of a sealed inner barrel 18 reduces the amount of drilling mud that cakes on the surface of the core 58 prior to drilling the core itself.

During the well coring operation, the inner barrel with the sponge 50 is lowered into the subterranean well 56 at depths that result in a pressure much higher than that of atmospheric pressure. The sponge 50 is normally of the open celled type which, when subjected to increasing pressure, has a tendency to compress when the open cells are filled with a gas such as air. If the sponge 50 is inserted into the inner barrel 18 on the surface with the open cells therein filled with air, insertion into the well 58 at a higher pressure results in compression of the individual cells in the overall sponge 50. This compression results in reduced volume for absorption of mobile oil and an increased space between the surfaces of the sponge 50 and the core 58. It is preferable that the fit between the core 58 and the sponge 50 is relatively "tight" in order to, first, provide a contact between the surfaces to enhance the transfer of mobile oil from the core 58 to the sponge 50 and, second, to prevent the drilling mud that is caked around the core 58 to be disposed between the sponge 50 and the core 58.

In the preferred embodiment, the sponge 50, is a polyurethane foam with a very high porosity of around 70%. The permeability of this foam is approximately two darcies. To control filter cake, field salt water is utilized within the inner barrel 18. Since polyurethane foam by its nature is highly oil wettable, it resists saturation by field salt water. To overcome this resistance, the inner barrel 18 with the polyurethane foam in place is evacuated with a vacuum pump prior to placing the inner barrel 18 into the outer barrel 12. After the vacuum is effected (approximately ten inches of mercury) the polyurethane foam is then flooded with the field salt water to between 300 and 500 pounds per square inch (psi) pressure. This saturates the polyurethane foam. This wetting of the polyurethane foam is done just prior to the coring operation.

After saturation, the fluid is removed from the bore formed by the interior of the sponge 50 and the inner barrel 18. Although the fluid is drained therefrom, the open celled structure of the sponge 50 is permeated by the fluid. After draining, the inner barrel 18 is inserted into the outer barrel 12 with the diaphragm 24 in place. The fluid 54 is then disposed within the interior of the inner barrel 18 through the check valve 49 with the ball 48 removed and the ball 48 then inserted to effect the seal.

Field salt water is utilized in a situation where the oil saturation is desired since oil will displace this water from the sponge 50. The field salt water disposed in the open celled structure of the sponge 50 prevents collapse of these structures where the pressure increases after insertion of the apparatus 10 into the well 56. As oil or other subterranean fluid bleeds from the core 58, the water is displaced by the oil. In order not to contaminate the sponge 50 after the diaphragm 24 has been ruptured, the drilling mud is water based, preferably field salt water, which is readily distinguishable from the oil absorbed by the sponge 50, thereby facilitating analysis for the percentage of mobile oil contained in the sponge 50.

If water saturation of a core is to be determined with the sponge coring process, alternative fluids must be utilized. Since only a small amount of water is normally present in the core 58, it is necessary to enhance the accuracy of the retrieval and measurement process as much as possible. The mud that is used in drilling the well is preferably oil based, but it may be any base that is readily distinguishable from the water contained in the core and that does not combine with the water to form a different compound. The sponge 50 is saturated with high quality dry diesel oil. The procedure for saturating the polyurethane foam is the same as described above. This facilitates absorption of the water in the core which is readily distinguishable from the drilling fluid and the fluid contained in the sponge 50.

Under certain conditions, it is desirable to analyze the core 58 for $C0_2$. $C0_2$ at the pressures existing at the bottom of the well is normally in solution. As the apparatus 10 is retreived from the well 56 with the core 58 enclosed therein, the pressure decreases, thereby allowing the $C0_2$ to come out of solution as a gas. Normally this gas is allowed to escape and must be retained to measure the quantity thereof. To effect a measurement of this gas, the fluid utilized in the inner container is monoethanolamine, which is a water soluble chemical with a great chemical affinity for acidic gases such as $C0_2$ and/or $H_2S$. For example, laboratory tests indicate that a 15% solution of monoethanolamine can capture at room temperature and pressure at least 25 liters of $C0_2$ per foot of polyurethane foam sponge. By utilizing monoethanolamine, any $C0_2$ that escapes from the core is captured by the sponge 50 and can be analyzed as part of the overall analysis after retrieval of the sponge 50. The sponge 50 is impregnated with the monoethanolamine as described above with reference to the field salt water.

In summary, there has been provided an apparatus for sponge coring that utilizes a sealed inner barrel disposed within an outer well coring barrel. The inner barrel is sealed at one end with a rupturable diaphragm and at the other one with a check valve that allows efferent flow only. A sponge is disposed around the walls of the inner barrel for receiving the sponge and absorbing the subterranean fluids therefrom. A reciprocating piston is disposed within the well coring apparatus between the coring bit and the rupturable diaphragm. The reciprocal piston or piercer has a planar surface for contacting the core that is being formed and a conical shaped surface on the other side thereof. The apex of the conical shaped surface is operable to pierce the rupturable diaphragm upon contact therewith in response to the forming of the well core. A fluid is disposed in the sealed inner barrel to saturate the sponge disposed therein. The sealed inner barrel both contains the fluid to saturate the sponge and also prevents drilling mud from entering the inner barrel prior to forming of the core.

Although the preferred embodiment has been described in detail, it should be understood that various changes, substitutions and alterations can be made therein without departing from the spirit and scope of the invention as defined by the appended claims.

What is claimed is:

1. A well core drilling apparatus for recovery of subterranean fluid, comprising:

means for boring a well core containing subterranean fluid;

container means associated with said boring means for containing said well core;

sealing means for sealing said container means from the external environment;

an absorbant member disposed on the inner walls of said container and positioned adjacent said well core, said absorbant member for absorbing the subterranean fluid that bleeds from said well core; and means for breaking the seal formed by said sealing means in response to the forming of said core such that said core enters said container means relatively unobstructed.

2. The apparatus of claim 1 wherein said container means is filled with a relatively incompressible fluid that penetrates and saturates said absorbant member such that changes in pressure do not result in compression of said absorbant member.

3. The apparatus of claim 1 wherein said container means comprises a hollow fluid impermeable right circular cylinder.

4. The apparatus of claim 3 wherein said absorbant member comprises an absorbant right circular cylinder with a bore defined therethrough and dimensioned to fit within said impermeable cylinder adjacent the walls thereof and axially aligned therewith.

5. The apparatus of claim 3 wherein said sealing means comprises:

a check valve disposed on the open end of said impermeable cylinder diametrically opposite the receiving end of said impermeable cylinder; and a rupturable diaphragm disposed over the receiving end of said impermeable cylinder.

6. The apparatus of claim 5 wherein said seal breaking means comprises a slideable piercer having a conical shaped end with the apex thereof oriented away from said well core being formed, said piercer slideable within said boring means such that forming of said core causes said piercer to reciprocate against said rupturable diaphragm in response to the forming of said well core to rupture said rupturable diaphragm and form a hole therethrough larger than said well core to allow said well core to pass therethrough.

7. The apparatus of claim 1 wherein said sealing means comprises a rupturable diaphragm disposed over the receiving end of said container means.

8. The apparatus of claim 7 wherein said seal breaking means comprises a slideable piston for reciprocation within said container means in response to the forming of said well core, said piston having a conical shaped end with the apex thereof adjacent said rupturable diaphragm for piercing thereof and a planar surface adjacent said well core, the forming of said well core causing said piston to reciprocate through said rupturable diaphragm and into said container means.

9. A well core drilling apparatus for recovery of subterranean fluid in a well core, comprising:

an outer barrel for rotation in a bore hole;

a drill bit mounted on the end of said outer barrel for drilling a core;

means for rotating said outer barrel;

an inner barrel disposed within said outer barrel and stationary with respect to the rotation of said outer barrel;

absorbant means disposed in said inner barrel for enclosing and containing the well core and absorbing subterranean fluids contained therein to provide a profile thereof along the longitudinal axis of the well core;

sealing means disposed on the receiving end of said inner barrel to provide a seal therefor;

check valve means disposed on the end of said inner barrel opposite said sealing means for allowing fluid flow only from the interior of said inner barrel to the exterior thereof, said check valve means and said sealing means sealing said inner barrel; and piercing means disposed in said outer barrel and slideable therein for breaking the seal formed by said sealing means in response to the forming of the well core.

10. The apparatus of claim 9 wherein said absorbant means comprises a hollow cylinder of absorbant material and disposed in said inner barrel proximate to the sides of the well core for absorbing the subterranean fluids therefrom.

11. The apparatus of claim 10 wherein said absorbant material is compressible, the interior diameter of said hollow cylinder of absorbant material less than the diameter of the well core such that said compressible material is compressed to form a tight fit around the well core.

12. The apparatus of claim 11 wherein said compressible material is polyurethane foam.

13. The apparatus of Claim 9 wherein said sealing means comprises a rupturable diaphragm disposed on the receiving end of said inner barrel for preventing passage of drilling fluids therethrough.

14. The apparatus of claim 13 wherein said piercing means comprises a piston slideably mounted within said outer barrel along the longitudinal axis thereof, said piston having a planar surface proximate said drill bit and a conical shaped surface proximate said rupturable diaphragm with the apex thereof for piercing said rupturable diaphragm in response to the forming of the well core, said piston preceding the well core through said inner barrel.

15. The apparatus of claim 9 wherein said inner barrel is filled with a fluid.

16. The apparatus of claim 15 wherein said fluid comprises a salt water formation.

17. A well core drilling apparatus for recovery of well cores containing subterranean fluids, comprising:

an outer barrel for lowering into a bore hole;

a coring drill bit disposed on the end of said outer barrel and rotatable therewith;

means for rotating said outer barrel to form the well core;

a sealed inner barrel disposed in said outer barrel for receiving the well core, said inner barrel having;

a rupturable diaphragm disposed on the receiving end of said inner barrel for preventing passage of the well core therethrough, a check valve disposed on the opposite end of said inner barrel for allowing fluid flow only from the interior thereof, a layer of polyurethane foam disposed on the interior surface of said inner barrel to form a bore therethrough, the inner diameter of said bore slightly less than the diameter of the well core, and a salt water formation fluid disposed therein; and a piston disposed in said outer barrel between said coring bit and said inner barrel and aligned along the longitudinal axis of said outer barrel, said piston having a planar surface adjacent said coring bit and a conical shaped surface adjacent said rupturable diaphragm with the apex thereof for piercing said rupturable diaphragm in response to the forming of the well core, said fluid in said sealed inner barrel protecting said foam from the external environment in the bore hole until the well core is formed.

18. A method for drilling a well core and recovering subterranean fluids disposed therein, comprising:

disposing an absorbant material in the inner barrel of a well coring apparatus for absorbing the subterranean fluid that is contained in the well core for later retrieval and analysis;

sealing the inner barrel from the external environment of the well core; and breaking the seal of the inner barrel in response to forming of the well core such that the absorbant material is protected until the well core is formed.

19. The apparatus of claim 18 further comprising disposing a fluid in the sealed inner barrel prior to the well core entering the inner barrel.

20. The method of claim 18 wherein the step of breaking the seal comprises disposing a piston between the well core being formed and the inner barrel of the well coring apparatus, the piston slideable therein such that formation of the well core causes the piston to break the seal on the inner barrel thereby allowing the well core to enter the inner barrel.

21. A method for forming a well core and retrieving subterranean fluid contained therein, comprising:

disposing a porous material having a plurality of pores disposed therein adjacent the interior walls of the inner barrel of a well coring apparatus;

saturating the porous material with a fluid the fluid preventing compression of the porous material with increasing pressure; and forming the well core with the well coring apparatus such that the well core is disposed in close proximity to the porous material.

22. The apparatus of claim 21 further comprising the steps of:

sealing the inner barrel after saturating the porous material; and breaking the seal of the inner barrel prior to forming the well core.

23. The apparatus of claim 22 further comprising disposing the fluid within the interior of the sealed inner barrel.

24. The apparatus of claim 21 wherein the porous material is saturated with the fluid under a pressure higher than atmospheric pressure after evacuating the pores of the porous material under a vacuum.

25. The apparatus of claim 21 wherein the step of disposing comprises disposing a layer of polyurethane sponge with a high porosity adjacent the interior wall of the inner barrel of the well coring apparatus.

26. The method of claim 21 wherein the fluid has an affinity for a desired subterranean fluid such that fluid flowing from the well core to the porous material is combined with the fluid for retention therein and later separation.

27. The method of claim 26 wherein the desired subterranean fluid is carbon dioxide and the fluid is monoethanolamine.

28. A method for forming a well core and retrieving subterranean fluid contained therein, comprising:

disposing a porous sponge adjacent the interior walls of the inner barrel of a well coring apparatus;

sealing the inner barrel with temporary seals;

drawing a vacuum on the inner barrel;

filling the inner barrel with a pressurized fluid to saturate the sponge with the fluid;

replacing the temporary seals on the inner barrel with rupturable seals;

disposing the inner barrel with the rupturable seals within the outer barrel of the well coring apparatus;

lowering the well coring apparatus into a subterranean well and;

rupturing the rupturable seal on the inner barrel in response to forming the well core such that the well core can enter the inner barrel and the fluid in the pores of the sponge prevents compression of filter the sponge.

29. A method for forming a well core and retrieving subterranean fluid contained therein, comprising:

saturating an absorbant material with a fluid that is distinguishable from the desired subterranean fluid to be retrieved and immiscible therewith;

disposing the saturated absorbant material in the inner barrel of the well coring apparatus; and forming the well core with a lubricating substance that is distinguishable from the desired, subterranean fluid to be retrieved and immiscible therewith such that the saturated absorbant material is adjacent the formed well core for absorption of the desired subterranean fluid wherein the desired subterranean fluid passing from the formed well core to the absorbant material is distinguishable from both the fluid saturating the absorbant material and the lubricating substance utilized in forming the well core.

30. The apparatus of claim 29 wherein the fluid is a water soluble fluid and the lubricating substance is water soluble mud such that non-water soluble subterranean fluids contained in the well core can be distinguished therefrom.

31. The method of claim 29 wherein the fluid is a non-water soluble fluid and the lubricating substance is non-water soluble such that water absorbed in the absorbant material is distinguishable from the non-water soluble fluid and lubricating substance.

32. A method for forming a well core and retrieving subterranean fluid contained therein, comprising:

saturating a porous material with a non-water soluble fluid;

disposing the saturated porous material in the inner barrel of the well coring apparatus; and forming the well core with a non-water soluble lubricating substance such that water that passes from the well core to the porous material is distinguishable from the non-water soluble fluid contained in the porous material and the non-water soluble lubricating substance used in forming the well core.

33. The method of claim 32 wherein the non-water soluble fluid comprises dry diesel oil.

34. The method of claim 33 wherein the non-water soluble lubricating material comprises oil based mud.

* * * * *